US006231214B1

(12) United States Patent
Haugaard

(10) Patent No.: US 6,231,214 B1
(45) Date of Patent: May 15, 2001

(54) RECESSED CANOPY LIGHT FIXTURE

(75) Inventor: Eric J. Haugaard, Kenosha, WI (US)

(73) Assignee: Ruud Lighting, Inc., Racine, WI (US)

( * ) Notice: Subject to any disclaimer, the term of this patent is extended or adjusted under 35 U.S.C. 154(b) by 0 days.

(21) Appl. No.: 09/392,986

(22) Filed: Sep. 9, 1999

(51) Int. Cl.[7] ..... F21V 17/00

(52) U.S. Cl. ..... 362/375; 362/147; 362/366; 362/455

(58) Field of Search ..... 362/147, 365, 362/366, 374, 375, 455

(56) References Cited

U.S. PATENT DOCUMENTS

| | | | | |
|---|---|---|---|---|
| 1,963,218 | | 6/1934 | Wakefield . | |
| 2,225,217 | | 12/1940 | Hicok . | |
| 2,700,751 | | 1/1955 | Hallerberg . | |
| 2,712,120 | | 6/1955 | Cochran . | |
| 3,064,851 | | 11/1962 | Guigli . | |
| 3,863,306 | * | 2/1975 | Duchatellier | 362/455 X |
| 4,141,061 | | 2/1979 | Ford et al. | 362/216 |
| 4,222,093 | | 9/1980 | Garcia et al. | 362/147 |
| 4,516,196 | | 5/1985 | Blake | 362/311 |
| 4,538,217 | | 8/1985 | Ewing et al. | 362/375 |
| 4,587,602 | | 5/1986 | Dean et al. | 362/375 |
| 4,827,386 | | 5/1989 | Mackiewicz | 362/267 |
| 4,837,669 | | 6/1989 | Tharp et al. | 362/418 |
| 4,910,650 | | 3/1990 | Goralnik | 362/147 |
| 5,278,737 | | 1/1994 | Luce et al. | 362/147 |
| 5,662,407 | | 9/1997 | Fischer et al. | 362/147 |
| 5,746,503 | | 5/1998 | Hillstrom et al. | 362/248 |

* cited by examiner

*Primary Examiner*—Stephen Husar
(74) *Attorney, Agent, or Firm*—Jansson, Shupe & Munger Ltd.

(57) ABSTRACT

A recessed canopy light having a main body positionable above an opening in a canopy sheet, a rim member in contact with the lower surface of the canopy sheet such that the sheet is sandwiched between the main body and the rim member, a lens frame below the rim member and hinged thereto, each hinge including a first member secured to the rim member and having an upwardly-open substantially semi-cylindrical female portion with an outer edge spaced below the canopy sheet by a first distance and a second member secured to the lens frame and having a truncated-cylindrical male portion engaged in the female portion, the male portion having a flat therealong such that the vertical dimension of the male portion varies between a full diameter much greater than the first distance and a truncated diameter which is at most slightly greater than the first distance, such that the male portion is non-removable from the female portion except when the lens frame is pivoted to a fully-open position beyond a vertical hanging position. Preferred embodiments include dimensioning such that deflection of the canopy sheet is necessary to allow disengagement of the hinge members.

20 Claims, 6 Drawing Sheets

RECESSED CANOPY LIGHT FIXTURE

FIELD OF THE INVENTION

This invention is related generally to light fixtures and, more particularly, to light fixtures installed on overhead canopy structures.

BACKGROUND OF THE INVENTION

Light fixtures that are mounted to overhead canopy structures, such as are increasingly common for gasoline service stations, truck stops and the like, are well known in the lighting art. Such light fixtures serve the purpose of providing light to outdoor areas which are partially protected from the elements by the canopy structures, which are high overhead. Canopy light fixtures are typically mounted to the horizontal sheet which forms the overhead ceiling of the canopy structure.

Some canopy light fixtures are below the horizontal sheet of the canopy structures and some are above—recessed into the canopy structure. For aesthetic reasons, such recessed mountings, with the main body of the light fixtures above the canopy sheet, are preferred.

Such canopy light fixtures typically include a lamp inside, which requires changing or other service from time to time, and a lens cover which is closed during use but opened for service—to allow access to the lamp inside or allow cleaning of inside and outside lens surfaces or replacement of the lens, or other service. The high overhead mounting and the fact that the fixtures are to be recessed above the canopy sheet tend to make installation and regular maintenance of the light fixtures difficult and time-consuming functions. The size and weight of canopy-light parts, including the size and weight of their lens covers, make installation difficult.

Previous canopy light fixtures have had significant shortcomings particularly when it came to attaching the lens frame to the main body. Various known lights have required more than one person for convenient installation. Considerable efforts have been made in the past to facilitate installation and maintenance. An example is the canopy light fixture disclosed in United States Patent No. 5,662,407 (Fischer et al.). There remain considerable problems and shortcomings in installation and maintenance of canopy light fixtures. There is a need for canopy light assemblies for which parts having weights well less than the overall fixture weight can be installed separately, thereby to reduce the physical loads borne by the installer. There is a need for an improved canopy light which allows easy attachment of a lens cover during installation and easy removal of a lens cover during maintenance, while still providing reliable attachment to the main body of the canopy light. There is a need for an improved canopy light having a secure way to retain the lens cover when in the open position, as for maintenance.

Various canopy lights of the prior art have a variety of mechanisms and systems for attachment of their lenses or lens covers. There is a need for a simple and highly reliable hinging attachment of a lens cover to the remainder of a canopy light fixture. There is a need for a hinging attachment which facilitates installation, removal and opening of a canopy light for maintenance purposes. Such a canopy light would be an important improvement in the lighting-fixture art.

OBJECTS OF THE INVENTION

It is an object of this invention to provide an improved recessed-canopy light fixture that overcomes some of the problems and shortcomings of the prior art.

Another object of this invention is to provide a canopy light fixture that is easy to install.

Another object is to provide a canopy light fixture having a hinge that allows for easy opening and removal of the lens frame.

Still another object of the invention is to provide a canopy light fixture having a removable lens frame.

Another object of the invention is to provide an improved canopy light fixture which simplifies installation by allowing assembly of a main portion followed by attachment of a lens cover, thereby to reduce weights of parts to be lifted overhead by the installer.

Another object of this invention is to provide a canopy light which allows easy attachment and removal of a lens cover but still has the lens cover reliably secured to the remainder of the light fixture, whether the cover is open or closed.

Another object of this invention is to provide an improved canopy light having a secure way to retain the lens cover when in the open position, as for maintenance.

Still another object of this invention is to provide a canopy light fixture with a simple and highly reliable hinge apparatus.

These and other objects of the invention will be apparent from the following descriptions and from the drawings.

SUMMARY OF THE INVENTION

The invention is an improved canopy light fixture of the recessed-mounting type which overcomes many of the above-noted problems and shortcomings of prior art canopy lights.

The fixture is of the type that is installed in an overhead canopy having a rigid horizontal canopy sheet with upper and lower surfaces and a fixture-receiving opening defined by a lip. The canopy light fixture itself includes a main body that is positioned at the opening above the sheet in contact with the upper surface. A rim member is in contact with the lower surface of the canopy along the lip in such a manner that the sheet is sandwiched between the main body and the rim member. A lens frame is positioned below and connected to the rim member by at least one hinge of a type characterizing the instant invention.

The hinge includes a first hinge member which is secured to the rim member and extends laterally therefrom. The first hinge member has an upwardly-open substantially semi-cylindrical female portion with an outer edge that is spaced below the canopy sheet by a first distance. A second hinge member is secured to the lens frame and extends laterally therefrom. The second hinge member has a truncated-cylindrical male portion that is received in the female portion such that the female and male portions define a hinge axis which is substantially tangential to the opening. The male portion includes a flat portion (referred to herein as a "flat") such that the vertical dimension of the male portion, depending on the orientation of the lens cover between its extreme fully-closed and fully-open positions, varies between a full diameter which is substantially greater than the first distance and a truncated diameter which is at most slightly greater than the first distance such that the male portion is non-removable from the female portion except when the lens frame is pivoted to a fully-open position -well beyond a vertical hanging position.

In certain highly preferred embodiments of the invention, the canopy light structure of this invention takes advantage of the deflectability of the canopy sheet to which the canopy light is mounted to provide extra attachment security of the lens cover to the remainder of the canopy light fixture. In such embodiments, the first distance, that is, the distance between the outer edge of the female portion of the hinge and the canopy sheet is slightly less than the truncated diameter such that removal of the second hinge member from the first hinge member requires a slight upward deflection of the canopy sheet immediately adjacent to the hinge—in order to provide the space necessary to remove the male portion from between the canopy sheet and the female portion. This helps to preventing inadvertent separation of the lens cover of the canopy light, particularly when the lens cover is hanging in an open position for service of the light fixture.

In a preferred embodiment of the invention, the truncated diameter is about 60–90% of the full diameter. For the most preferred embodiments, the truncated diameter is about 75% of the length of the full diameter.

In certain preferred embodiments, the upwardly-open substantially semi-cylindrical female portion includes a nadir and an inner edge spaced from the outer edge, the outer edge being vertically spaced from the nadir by a second distance that is less than the full diameter. In highly-preferred embodiments, such second distance is about equal to half the full diameter. In preferred embodiments, the inner and outer edges of the female portion are horizontally spaced by a third distance which is slightly greater than the full diameter; this tends to facilitate a fully-nested hinging arrangement and good hinging action. In another preferred embodiment, the inner edge is vertically spaced from the canopy sheet by a fourth distance which is less than the first distance; this facilitates disengagement of the hinge members by preventing over-engagement during lifting of the lens cover in initial movement toward detachment.

In a still more preferred embodiment of the invention, the flat of the male portion, which itself is plane parallel to the hinge axis, forms an acute angle with respect to the plane of the canopy sheet when the lens frame is in its closed position (orientation), and is substantially parallel to the plane of the canopy when the lens frame is pivoted to a fully-open position—with the lens cover pivoted to well beyond a vertical hanging position. In a specific version of such embodiment, the acute angle is at about 45° to the plane of the canopy sheet when the lens frame is in its closed position.

The structures, dimensions, angles and relationships of the hinge and the overall canopy light fixture, in its mounted position, provide significant advantages both in installation of the fixture and in overhead maintenance operations.

BRIEF DESCRIPTION OF THE DRAWINGS

The drawings illustrate preferred embodiments which include the above-noted characteristics and features of the invention. The invention will be readily understood from the descriptions and drawings. In the drawings:

FIG. 1 is a perspective view showing a plurality of the canopy lights of this invention installed in an overhead canopy of a service station or the like.

DETAILED DESCRIPTIONS OF PREFERRED EMBODIMENTS

In describing the invention, it is useful to first discuss the environment in which the invention is used.

Figure 1:
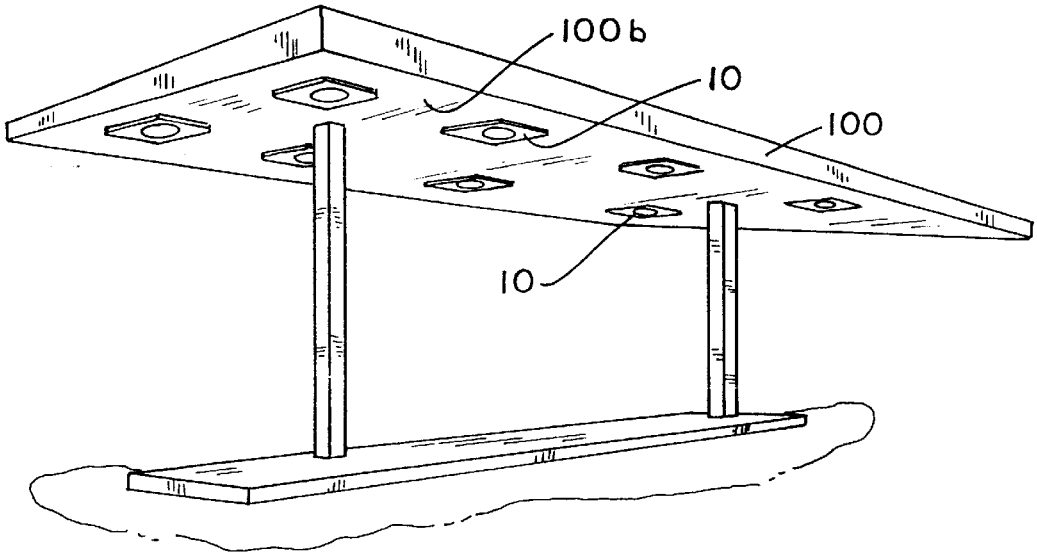
Figure 2:
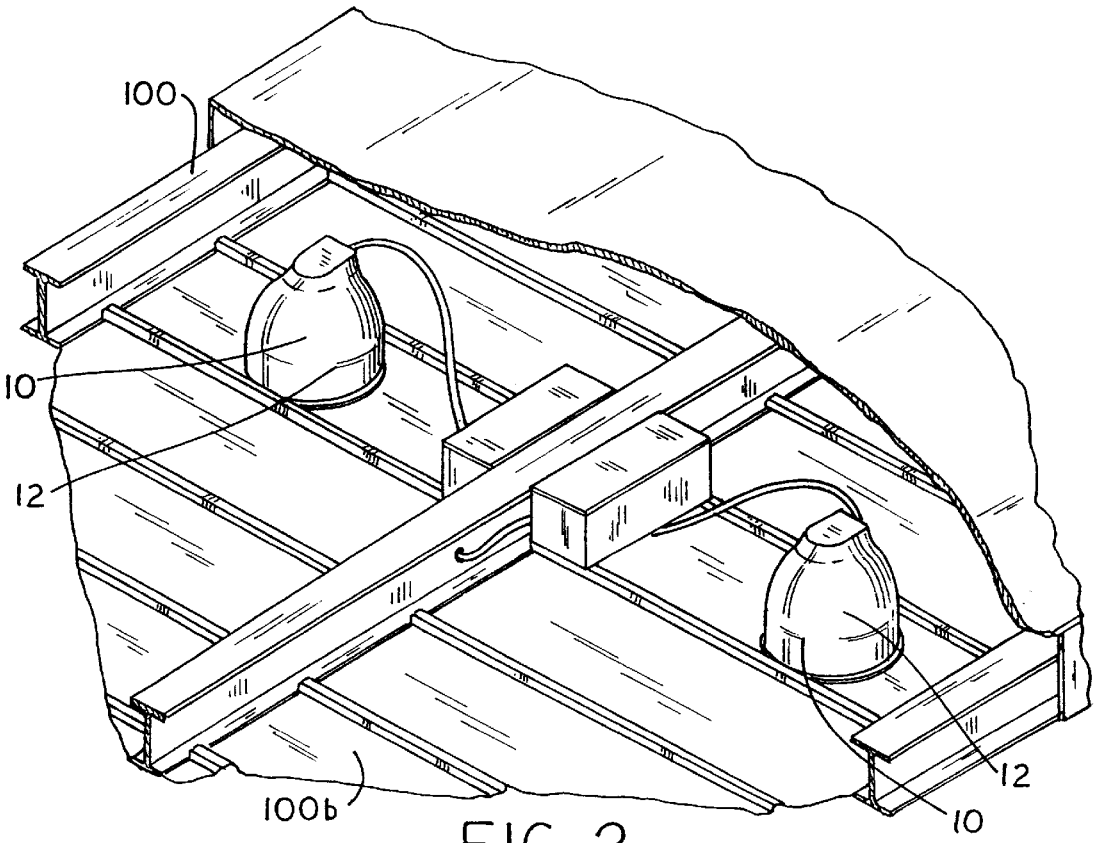
FIG. 2 is a perspective view from above the canopy, with portions of the canopy removed to show the main body of the canopy light positioned on the upper surface of the canopy sheet.
Figure 3:
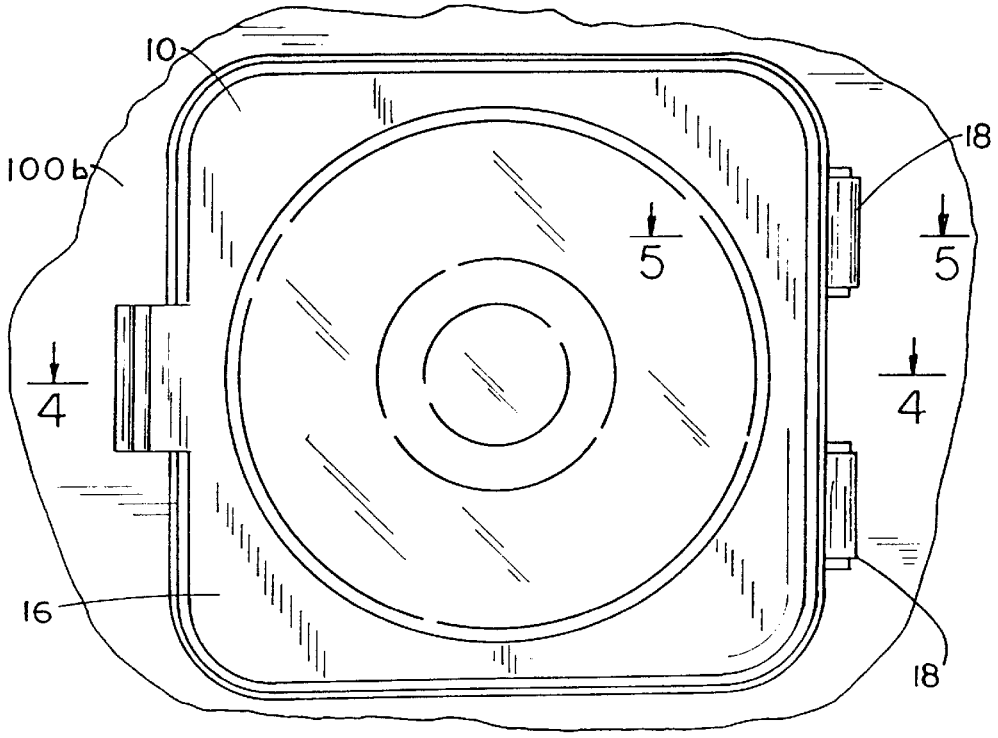
FIG. 3 is a bottom plan view of the canopy light with the lens frame in its closed position.
Figure 4:
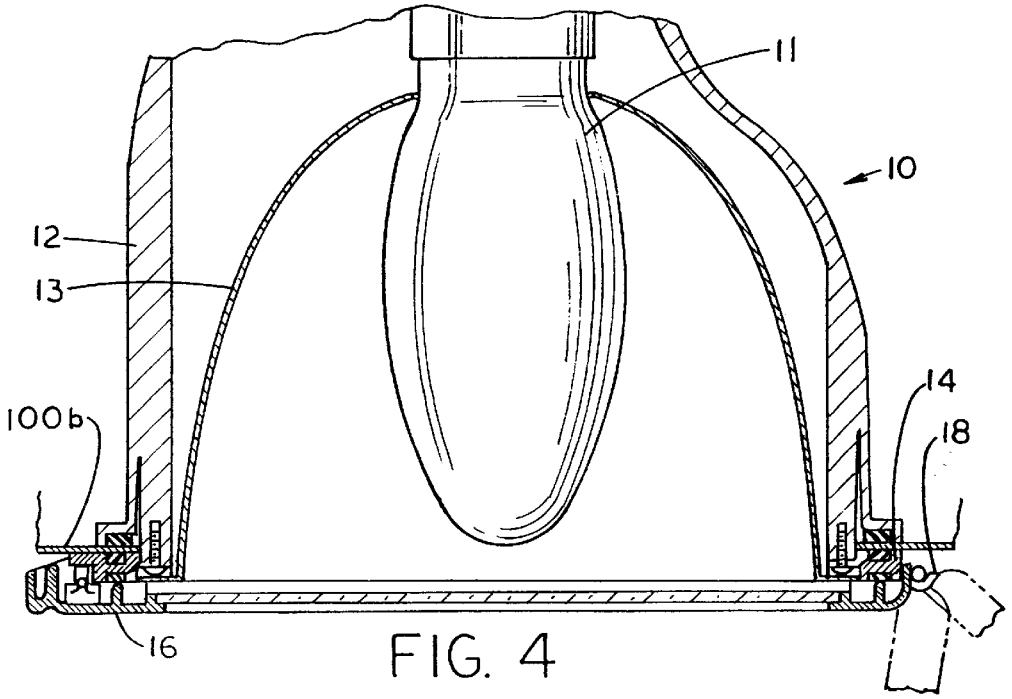
FIG. 4 is a side sectional view of the canopy light, taken along section 4—4 as indicated in FIG. 3, showing a lamp secured within the main body.

FIG. 1 shows a canopy 100 of the type found over gasoline islands at service stations and service ports at drive-in restaurants or the like. A number of canopy lights 10 are installed in canopy 100 in recessed fashion, positioned over openings 100*a*, an example of which is shown best in FIG. 9A, which have been cut or otherwise formed in a horizontal canopy sheet 100*b*. The recessed positioning of each canopy light fixture 10 is illustrated best in FIGS. 1, 2 and 9B–9D. Each opening 100*a* is defined by a lip 100*c*, and each canopy light fixture 10 engages canopy sheet 100*b* about opening lip 100*c*. Canopy lights 10 are accessible from below canopy sheet 100*b*.

FIGS. 2–4 and 9A–9D serve to illustrate how canopy light fixture 10 is installed in overhead canopy 100. As shown best in FIGS. 9A–9D, canopy sheet 100*b*, which is a generally rigid but slightly deflectable sheet (usually of sheet metal), has upper and lower surfaces 100*d* and 100*e*, respectively. Opening 100*a* is cut to a dimension accommodating the parts of canopy light 10, such that lip 100*c* can be sandwiched between such parts, above and below it. The installation of canopy light 10 will be described by reference to FIGS. 9B–9D after the parts of canopy light 10 are further described, particularly by reference to FIGS. 3–8.

Canopy light fixture 10 includes a main body 12 positioned at opening 100*a* above sheet 100*b* of canopy 100 in contact with upper surface 100*d* in alignment with lip 100*c*. A rim member 14 is in contact with lower surface 100*e* of canopy 100 along and in alignment with lip 100*c*, in a manner such that sheet 100*b* is sandwiched between main body 12 and rim member 14.

As shown best in FIGS. 3–8, a lens frame 16 is positioned below and connected to rim member 14 by a pair of hinges 18. Each hinge 18 includes a first hinge member 20 secured to and extending laterally from rim member 14, and a second hinge member 30 secured to and extending laterally from lens frame 16. First and second hinge members 20 and 30 are held together, in both the open and the closed positions of lens frame 16, only by virtue of their dimensioning and their positioning with respect to lower surface 100*e* of canopy sheet 100*b*.

Figure 5:
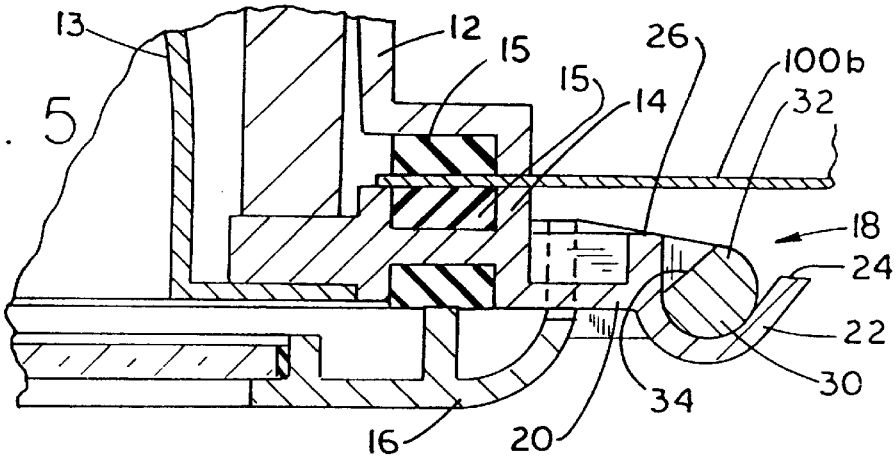
FIG. 5 is an enlarged side sectional view of the hinge member of the canopy light, showing the relationship of the first and second hinge members and the canopy sheet when the lens frame in the closed position.
Figure 6:
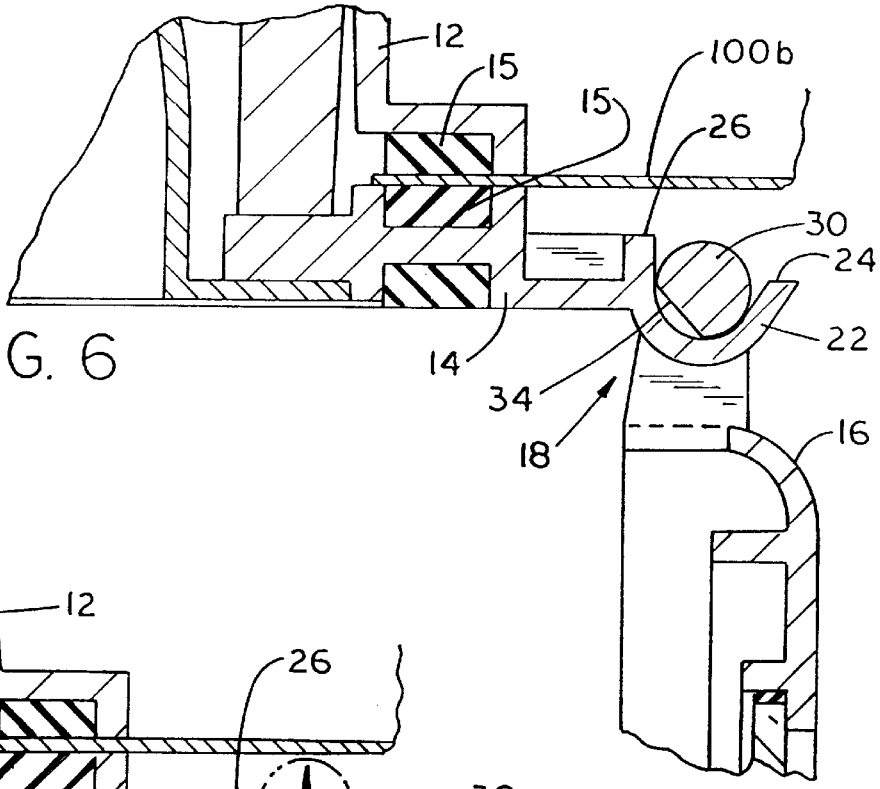
FIG. 6 is a sectional view as in FIG. 5, but illustrating the lens frame in its hanging-open position.

First hinge member 20 of hinge 18 has an upwardly-open substantially semi-cylindrical female portion 22 with an outer edge 24 that is spaced below canopy sheet 100*b* by a first distance $D_1$ (see FIG. 5). Second hinge member 30 of hinge 18 has a truncated-cylindrical male portion 32 that is received in female portion 22 of first hinge member 20 such that female and male portions 22 and 32 define a hinge axis which is substantially tangential to opening 100*a* and to the various major parts of canopy light 10.

Figure 7A:
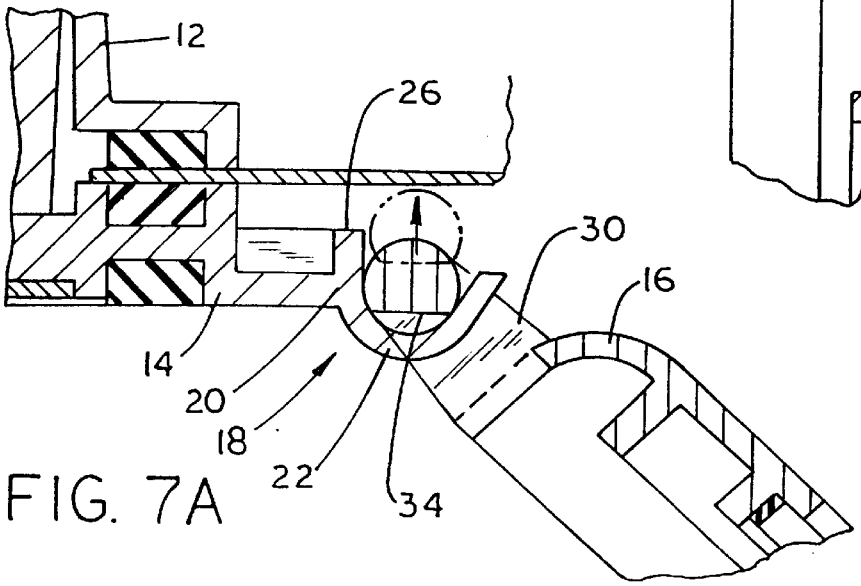
FIG. 7A is still another sectional view as in FIG. 5, but illustrating the lens frame in its fully-open position, beyond a vertical hanging position.
Figure 7B:
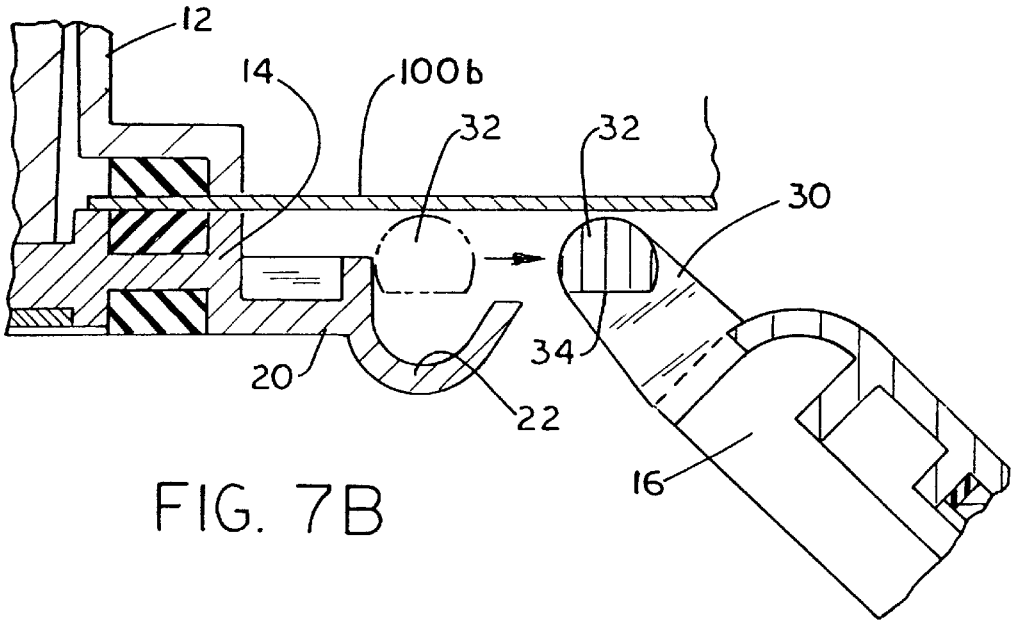
FIG. 7B is still another sectional view as in FIG. 5, but illustrating the lens frame in a disengaged position, with the male portion of the second hinge member removed from the female portion of the first hinge member.

Female and male portions 22 and 32, and the surrounding parts, including canopy sheet 100*b*, are configured, positioned and arranged such that male portion 32 can freely rotate through an angle of at least about 135° within female portion 22, and lens frame 16 (i.e., the lens cover door) can pivot freely through an angle of at least about 135° between its closed position (see FIGS. 3, 5 and 9D) and a fully-open position (see FIG. 7B).

As shown in FIGS. 5, 6, 7A and 7B, male portion 32, which may be described as a solid pin, stud or bar having an outer shape in the form of a modified cylinder, includes a flat 34 along the length of such cylinder and parallel thereto. Flat 34 is such that the cross-dimension of male portion 32, which may also be described as its "vertical dimension" when in the mounted position, varies between a full diameter $D_F$ which is substantially greater than first distance $D_1$ and a truncated diameter $D_T$ which is slightly less than (nearly equal to) first distance $D_1$. Given this configuration and dimensioning, male portion 32 is non-removable from female portion 22 except when lens frame 16 is pivoted to an essentially fully-open position (as shown in FIGS. 7A and 7B), well beyond the vertical hanging position shown in FIG. 6.

These configurations, dimensions and relationships facilitate easy assembly of the lens cover with the remainder of the canopy light during installation, and allow easy removal of the lens cover for services. Furthermore, such configurations, dimensions and relationships allow lens frame 16 and its lens to be firmly held to the remainder of canopy light 10 even when lens frame 16 is pivoted to an open position for lamp changing, lens cleaning or other service.

Figure 10A:
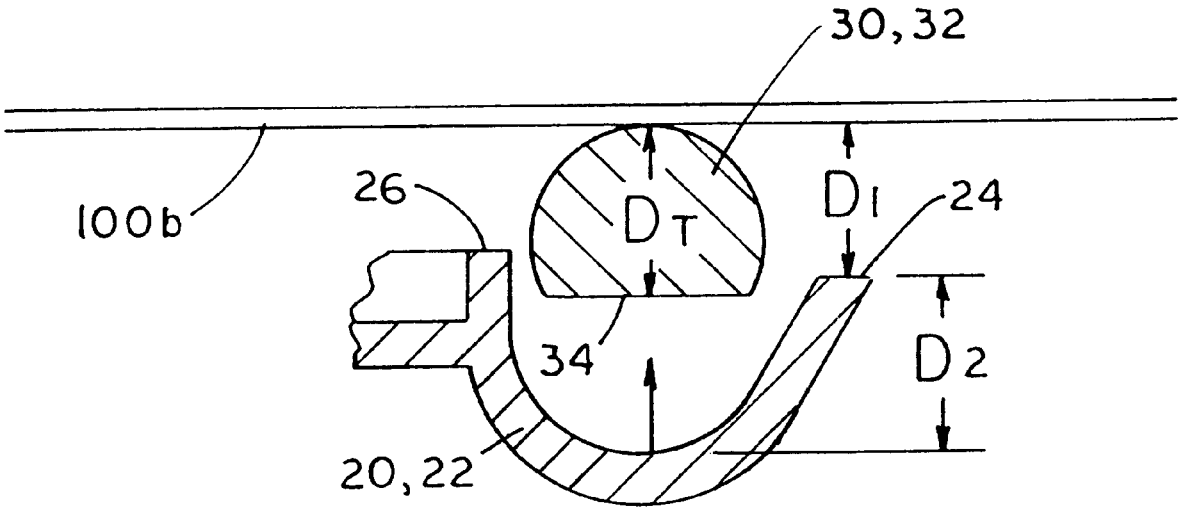
FIGS. 10A and 10B are enlarged fragmentary schematic side sectional views representing a slightly-modified, highly-preferred embodiment of the hinge members and the adjacent canopy.
Figure 10B:
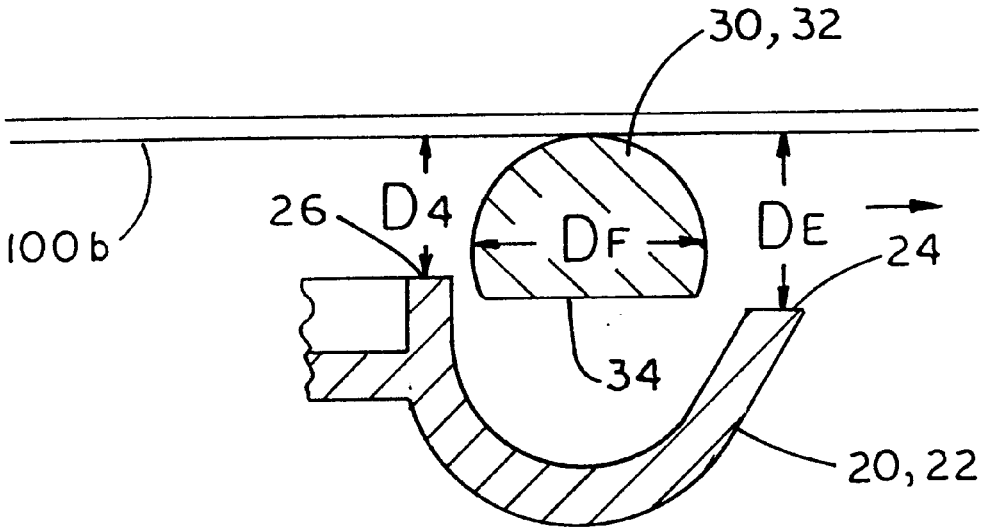

FIGS. 10A and 10B show a particularly preferred embodiment and will also be useful for representation of certain key dimensions and distances, some of which have already been referred to above. More particularly, the full and truncated diameters $D_F$ and $D_T$ of male portion 32 are labeled, as is distance $D_1$ between outer edge 24 of female portion 22 and canopy sheet 100*b* (see FIG. 10A). FIGS. 10A and 10B illustrate only the positions and relationships of female and male portions 22 and 32 and canopy sheet 100*b* when lens frame 16 is in its fully-open position, as also represented in FIGS. 7A and 7B with respect to the embodiment thereof.

In the highly preferred embodiment of FIGS. 10A and 10B, canopy sheet 100*b* is capable of upward deflection upon application of pressure, and this common characteristic of overhead canopies is used to provide extra security in the engagement of second hinge member 30 in first hinge member 20; stated more specifically, extra security is provided in the engagement of male portion 32 in female portion 22. This is done by dimensioning the parts such that distance $D_1$, that is, the distance between canopy sheet 100*b* and outer edge 24 of female portion 22, is somewhat less than truncated diameter $D_T$, as illustrated in FIG. 10. This prevents withdrawal of male portion 32 from its position between female portion 22 and canopy sheet 100*b*, unless canopy sheet 100*b* is deflected upwardly by application of upward pressure thereon applied through male portion 32. Such deflection to enlarge the distance between canopy sheet 100*b* and outer edge 24 of female portion 22 is illustrated in FIG. 10B, which represents the enlarged distance $D_E$. Such enlargement allows lateral movement of male portion 32 to remove it from between female portion 22 and canopy sheet 100*b*. With this arrangement and configuration, lens frame 16 is restricted for inadvertent disengagement from the remainder of canopy light 10, even when lens frame 16 may be dangling unattended in the wind because of an interruption in maintenance service.

As noted above, FIGS. 10A and 10B will be used to illustrate other preferred features which are in all of the illustrated embodiments. Truncated diameter $D_T$ is about 75% of $D_F$, a particularly preferred relationship which facilitates the easy assembly and secure engagement features of this invention. The preferred ratio of 60–90% referred to above allows for much greater than a 90° rotation of male portion 32 within female portion 22, and about 75% is most preferred.

Upwardly-open substantially semi-cylindrical female portion 22 includes a nadir, represented by the lower end of the vertical arrow in FIG. 10A, and an inner edge 26 which is spaced from outer edge 24. Outer edge 24 is vertically spaced from the nadir by a second distance $D_2$ that is less than full diameter $D_F$. This allows for free rotation of male portion 32 without interference from the portion of second hinge member 30 that extends from lens frame 16. Second distance $D_2$ is about equal to half of full diameter $D_F$.

Outer and inner edges 24 and 26 are horizontally spaced by a third distance (not represented) which is slightly greater than full diameter $D_F$. This allows male and female portions to fully nest, where they define the hinge axis. Inner edge 26 is vertically spaced from canopy sheet 100*b* by a fourth distance $D_4$ (shown in FIG. 10B) which is less than first distance $D_1$. This allows the part of female portion 22 that forms inner edge 26 to provide a leverage point which is useful in assisting insertion and removal of male portion 32 with respect to female portion 22.

As illustrated in FIGS. 5 and 7A, 7B, 10A and 10B, flat 34 forms an acute angle with respect to the plane of canopy sheet 100*b* when lens frame 16 is in its closed position (FIG. 5), and is substantially parallel to the plane of canopy sheet 100*b* when lens frame 16 is pivoted to its fully-open position (FIGS. 7A, 7B, 10A and 10B) well beyond its vertical hanging position. In the closed position (FIG. 5), the acute angle is about 45°.

As discussed above, it is the orientation of flat 34 with respect to canopy sheet 100*b* which allows for insertion and removal of lens frame 16. This is because it is the truncated diameter—that is, the smallest cross-dimension of male portion 32, the cross-dimension measured from flat 34—which must be positioned perpendicular to canopy sheet 100*b* for male portion 32 to be able to move laterally out from between outer edge 24 and lower surface 100*e* of canopy sheet 100*b*. By requiring lens frame 16 to be opened beyond its vertical orientation before flat 34 is parallel to the plane of canopy sheet 100*b*, hinge 18 prevents lens frame 16 from accidently falling off rim member 14.

Figure 9A:
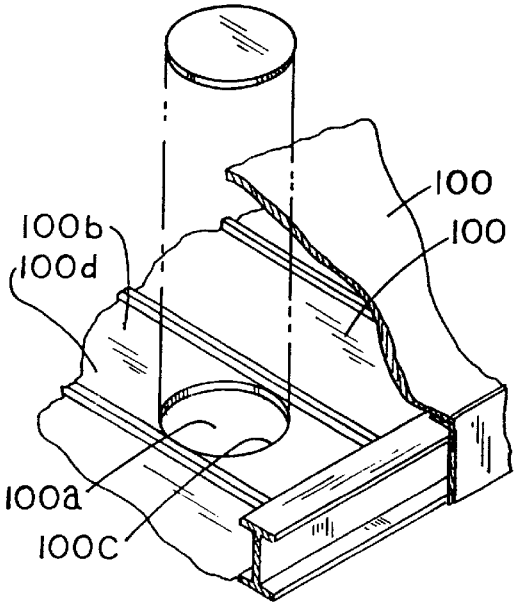
FIG. 9A is a perspective view of a section of the canopy showing an opening in the canopy sheet prior to installation of the canopy light fixture of this invention.
Figure 9B:
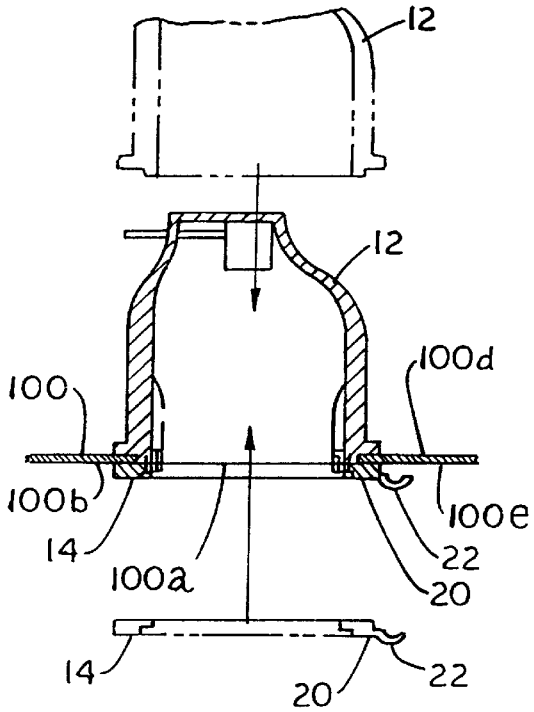
FIG. 9B is a side sectional view of the main body of the canopy light and a rim member coming toward each other at the opening in the canopy sheet for sandwiching engagement thereto on either side of the lip of the canopy sheet opening. The lens frame has not yet been installed.
Figure 9C:
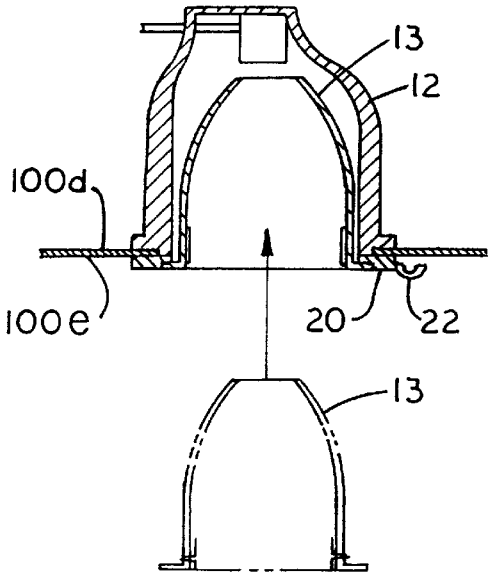
FIG. 9C is a similar side sectional view of the main body and rim member of the canopy light fixture, still without a lens frame positioned over an opening in the canopy sheet, but showing installation of the reflector of the canopy light fixture.

FIGS. 9A–9C are useful for describing the installation of canopy light fixture 10.

FIG. 9B shows main body 12 and rim member 14 coming toward canopy sheet 100*b* and each other at opening 100*a* on opposite sides of canopy sheet 100*b*, for sandwiching engagement thereto on either side of lip 100*c* of opening 10*a*. Lens frame 16 has not yet been installed, and it is not necessary to lift or support the weight of lens frame 16 at this point. Rim member 14 is suspended on main body 12 by means of temporary connectors (not shown), after which rim member 14 is permanently secured to main body 12 by means of screws (see FIG. 4). A pair of annular seals 15 engage the surfaces of canopy sheet 100*b*.

Figure 9D:
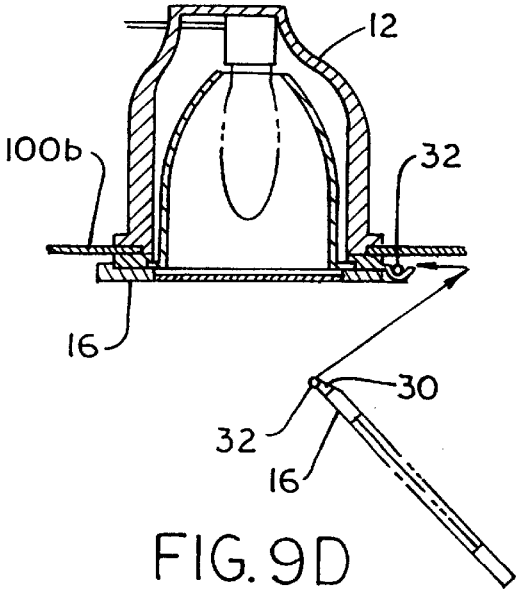
FIG. 9D is a similar sectional view, but now showing installation of the lens frame, the final step in the installation process.

FIG. 9C shows installation of a reflector 13 in main body 12. Lamp 11 extends through reflector 13. FIG. 9D shows installation of lens frame 16, which is the final step in the installation process. Such installation is after installation of the other portions of canopy light fixture 10 and, as explained above, merely involves engagement of male portion 32 of second hinge member 30 with female portion 22 of first hinge member 20, in position just below canopy sheet 100*b*. As shown best in FIG. 5, a lower annular seal 17 is secured to rim member 14 in position for engagement with an edge of lens frame 16 to allow sealing of canopy light fixture 10 when lens frame 16 is closed.

Figure 8:
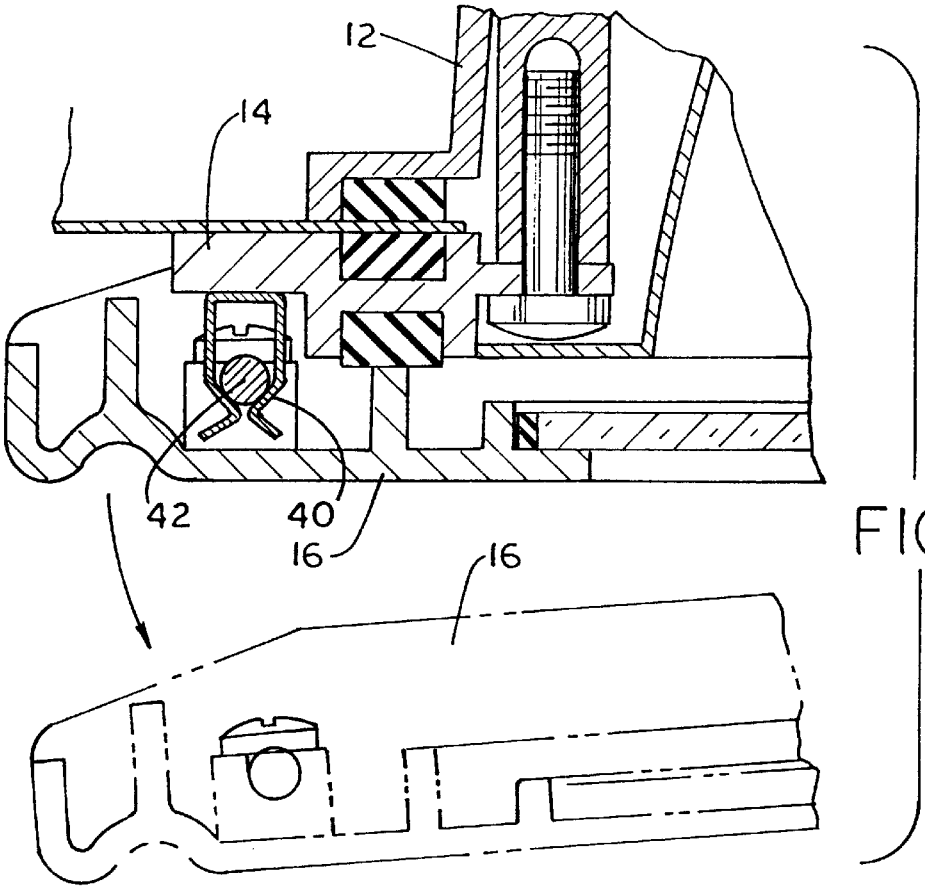
FIG. 8 is a sectional view of a portion of the canopy light fixture which is opposite the hinge member, showing the lens frame engaged to the rim member.

FIG. 8 shows the side of lens frame 16 and rim member 14 which are opposite the hinges, and illustrates a clasp device, including spring clip 40 and pin 42 which provide simple engagement to hold lens frame 16 in its closed position.

The canopy light fixture of this invention may be made using widely-available, well-known materials, all of which would be apparent to the person of ordinary skill in the art. The hinge members are preferably made of metal.

While the principles of this invention have been described in connection with specific embodiments, it should be understood clearly that these descriptions are made only by way of example and are not intended to limit the scope of the invention.

I claim:

1. A light fixture for installation in an overhead canopy having a rigid canopy sheet with upper and lower surfaces and a fixture-receiving opening therethrough defined by a lip, the light fixture comprising:

a main body positioned at the opening above the sheet in contact with the upper surface thereof;

a rim member in contact with the lower surface of the canopy sheet along the lip such that the sheet is sandwiched between the main body and the rim member;

a lens frame below the rim member and connected thereto by at least one member, the hinge including:

a first hinge member secured to the rim member and extending laterally therefrom, the first hinge member having an upwardly-open substantially semi-cylindrical female portion with an outer edge spaced below the canopy sheet by a first distance;

a second hinge member secured to the lens frame and extending laterally therefrom, the second hinge member having a truncated-cylindrical male portion in the female portion, the female and male portions defining a hinge axis substantially tangential to the opening and the male portion having a flat therealong such that the vertical dimension of the male portion varies between a full diameter substantially greater than the first distance and a truncated diameter which is at most slightly greater than the first distance, whereby the male portion is non-removable from the female portion except when the lens frame is pivoted to a fully-open position beyond a vertical hanging position.

2. The canopy light fixture of claim 1 wherein:

the canopy sheet is capable of deflection; and the first distance is somewhat less than the truncated diameter, whereby removal of the second hinge member requires a slight deflection of the canopy sheet, thereby preventing inadvertent separation of the lens member.

3. The canopy light fixture of claim 1 wherein the truncated diameter is about 60–90% of the length of the full diameter.

4. The canopy light fixture of claim 3 wherein the truncated diameter is about 75% of the length of the full diameter.

5. The canopy light fixture of claim 1 wherein:

the upwardly-open substantially semi-cylindrical female portion further includes a nadir and an inner edge, the inner edge being spaced from the outer edge; and the outer edge is vertically spaced from the nadir by a second distance less than the full diameter.

6. The canopy light fixture of claim 5 wherein the second distance is about equal to half the full diameter.

7. The canopy light fixture of claim 6 wherein the truncated diameter is about 60–90% of the length of the full diameter.

8. The canopy light fixture of claim 7 wherein the truncated diameter is about 75% of the length of the full diameter.

9. The canopy light fixture of claim 5 wherein the inner and outer edges are horizontally spaced by a third distance which is slightly greater than the full diameter.

10. The canopy light fixture of claim 5 wherein:

the inner edge is vertically spaced from the canopy sheet by a fourth distance which is less than the first distance.

11. The canopy light fixture of claim 1 wherein the flat forms an acute angle with respect to the plane of the canopy sheet when the lens frame is in a closed position and is substantially parallel to the plane of the canopy when the lens frame is pivoted to a fully-open position well beyond a vertical hanging position.

12. The canopy light fixture of claim 11 wherein the acute angle is about 45° when the lens frame is in a closed position.

13. The canopy light fixture of claim 11 wherein:

the canopy sheet is capable of deflection; and the first distance is somewhat less than the truncated diameter, whereby removal of the second hinge member requires a slight deflection of the canopy sheet, thereby preventing inadvertent separation of the lens member.

14. The canopy light fixture of claim 13 wherein the truncated diameter is about 60–90% of the length of the full diameter.

15. The canopy light fixture of claim 11 wherein:

the upwardly-open substantially semi-cylindrical female portion further includes a nadir and an inner edge, the inner edge being spaced from the outer edge; and the outer edge is vertically spaced from the nadir by a second distance less than the full diameter.

16. The canopy light fixture of claim 15 wherein the second distance is about equal to half the full diameter.

17. The canopy light fixture of claim 16 wherein the truncated diameter is about 60–90% of the length of the full diameter.

18. The canopy light fixture of claim 15 wherein the inner and outer edges are horizontally spaced by a third distance which is slightly greater than the full diameter.

19. The canopy light fixture of claim 15 wherein:

the inner edge is vertically spaced from the canopy sheet by a fourth distance which is less than the first distance.

20. A light fixture for installation in an overhead canopy having a rigid canopy sheet, the light fixture comprising:

a main body positioned above the sheet;

a rim member below the sheet such that the sheet is sandwiched between the main body and the rim member;

a lens frame below the rim member and connected thereto by at least one member, the hinge including:

a first hinge member secured to the rim member and having an upwardly-open substantially semi-cylindrical female portion with an outer edge spaced below the canopy sheet by a first distance;

a second hinge member secured to the lens frame and having a truncated-cylindrical male portion in the female portion, the female and male portions defining a hinge axis and the male portion having a flat therealong such that the vertical dimension of the male portion varies between a full diameter substantially greater than the first distance and a truncated diameter which is at most slightly greater than the first distance, whereby the male portion is non-removable from the female portion except when the lens frame is pivoted to a fully-open position beyond a vertical hanging position.

* * * * *

UNITED STATES PATENT AND TRADEMARK OFFICE

CERTIFICATE OF CORRECTION

PATENT NO. : 6,231,214 B1
DATED : May 15, 2001
INVENTOR(S) : Eric J. Haugaard

It is certified that error appears in the above-identified patent and that said Letters Patent is hereby corrected as shown below:

Column 7,
Line 14, delete “10a” and substitute therefore -- 100a --.

Signed and Sealed this

Eighteenth Day of October, 2005

JON W. DUDAS
*Director of the United States Patent and Trademark Office*